US012765623B2

(12) United States Patent
Choong

(10) Patent No.: US 12,765,623 B2
(45) Date of Patent: Oct. 20, 2026

(54) S-SHAPED FASTENER FOR BACK OF BRA

(71) Applicant: Deborah Heng Huan Choong, Hong Kong (CN)

(72) Inventor: Deborah Heng Huan Choong, Hong Kong (CN)

( * ) Notice: Subject to any disclaimer, the term of this patent is extended or adjusted under 35 U.S.C. 154(b) by 174 days.

(21) Appl. No.: 18/793,080

(22) Filed: Aug. 2, 2024

(65) Prior Publication Data

US 2024/0389691 A1 Nov. 28, 2024

Related U.S. Application Data

(63) Continuation of application No. PCT/CN2023/116451, filed on Sep. 1, 2023.

(30) Foreign Application Priority Data

Sep. 6, 2022 (CN) ..... 202222367955.3

(51) Int. Cl.
*A41F 1/00* (2006.01)

(52) U.S. Cl.
CPC ..... *A41F 1/006* (2013.01)

(58) Field of Classification Search
CPC ..... A41F 1/006
See application file for complete search history.

(56) References Cited

U.S. PATENT DOCUMENTS 3,212,503 A * 10/1965 Gorman ..... A41F 1/006 450/32
3,520,033 A * 7/1970 Usuda ..... A44B 11/2588 24/DIG. 38
D325,546 S * 4/1992 Collier ..... D11/213
5,224,247 A * 7/1993 Collier ..... A44B 11/28 24/DIG. 42
5,380,238 A * 1/1995 Crew-Gee ..... A44B 11/263 24/616
5,784,765 A * 7/1998 Fildan ..... A41C 3/02 24/615
6,076,237 A * 6/2000 Goorhouse ..... A44B 11/263 24/615
6,793,556 B1 * 9/2004 Fildan ..... A41F 1/006 2/323
7,232,359 B1 * 6/2007 Richardson ..... A41C 3/0028 450/86
D739,785 S * 9/2015 Fildan ..... D11/218
9,756,906 B1 * 9/2017 Fink ..... A41F 1/006
D867,923 S * 11/2019 Li ..... D11/216

(Continued)

*Primary Examiner* — David M Upchurch
(74) *Attorney, Agent, or Firm* — Hemisphere Law, PLLC

(57) ABSTRACT

An S-shaped fastener for the back of a bra includes a left fastening part for connecting to a left end of the bra and a right fastening part for connecting to a right end of the bra. The left fastening part includes a left bottom plate, a left panel overlapped on a surface of the left bottom plate, and a left insertion notch formed between the left bottom plate and the left panel. The right fastening part includes a right bottom plate, a right panel overlapped on a surface of the right bottom plate, and a right insertion notch formed between the right bottom plate and the right panel. When the left fastening part is connected to the right fastening part, the left fastening part and the right fastening part are mutually embedded through the left insertion notch and the right insertion notch.

13 Claims, 13 Drawing Sheets

(56) References Cited

U.S. PATENT DOCUMENTS

| | | | | | |
|---|---|---|---|---|---|
| D882,459 | S | * | 4/2020 | Fildan | A44B 11/2588<br>D11/216 |
| 2009/0133230 | A1 | * | 5/2009 | Wanzenboeck | A41F 1/006<br>24/326 |
| 2012/0117764 | A1 | * | 5/2012 | Wong | A44B 11/258<br>24/302 |
| 2017/0172502 | A1 | * | 6/2017 | Rofe | A61B 5/4312 |
| 2018/0352884 | A1 | * | 12/2018 | Vanos | A41F 1/006 |

* cited by examiner

S-SHAPED FASTENER FOR BACK OF BRA

TECHNICAL FIELD

The present disclosure relates to the technical field of bras, and particularly to a fastener for the back of a bra, which is easy to untie or fasten.

BACKGROUND

As a daily article for women, a bra has two back pieces on its back, with several rows/columns of back buckles on one back piece and a row/column of back hooks on a free end of the other back piece. Each row/column of back buckles includes multiple back buckles, and the number of the row/column of back hooks is the same as the number of one row/column of back buckles. When the bra is used, a single back hook is buckled (i.e., connected) with a single back buckle. However, because of smaller sizes of the back buckles and back hooks, it is actually difficult for some special people, such as women with inconvenient hands or women with special body shapes, to fasten multiple back buckles and back hooks together when using currently commonly used bras. That is to say, it is difficult to wear the bras with the back buckles and the back hooks, and it is also difficult to untie the back buckles and back hooks. Therefore, the commonly used bras are not suitable for special people to use.

SUMMARY

In order to overcome the shortcomings of the related art, the present disclosure aims to provide an S-shaped fastener for the back of a bra, which aims to solve the problem that the existing bras are inconvenient to use.

In order to achieve the above objectives, an embodiment of the present disclosure provides an S-shaped fastener for the back of a bra. The S-shaped fastener for the back of the bra includes a left end of the bra, and a right fastening part for connecting to a right end of the bra. The left fastening part includes: a left bottom plate, a left panel overlapped on a surface of the left bottom plate, and a left insertion notch defined between the left bottom plate and the left panel. The right fastening part includes: a right bottom plate, a right panel overlapped on a surface of the right bottom plate, and a right insertion notch defined between the right bottom plate and the right panel. When the left fastening part is connected to the right fastening part, the left fastening part and the right fastening part are mutually embedded through the left insertion notch and the right insertion notch In an embodiment, the left bottom plate defines an L-shaped upper notch, a left side surface of the left panel is S-shaped, and the left insertion notch is a gap between an upper part of the left side surface and a vertical surface of the L-shaped upper notch. The right bottom plate defines an L-shaped lower notch, a right side surface of the right panel is S-shaped, and the right insertion notch is a gap between a lower part of the right side surface and a vertical surface of the L-shaped lower notch.

In an embodiment, when the left fastening part and the right fastening part are connected, the left side surface of the left panel and the right side surface of the right panel are attached to each other; and after the left side surface and the right side surface are attached to each other, a joint portion between the left side surface and the right side surface is S-shaped.

In an embodiment, multiple back hooks are disposed at a left edge of a bottom surface of the left bottom plate, and a right edge of the right bottom plate defines multiple fastening holes.

In an embodiment, the multiple back hooks are arranged in a column, and the number of the multiple back hooks is at least two; and the multiple fastening holes are arranged in a column, and the number of the multiple fastening holes is at least two.

In an embodiment, a first arc convex plate is disposed on a surface of the left panel, and an edge of the first arc convex plate is located in the middle of a left side edge of the left panel; and a second arc convex plate is disposed on a surface of the right panel, and an edge of the second arc convex plate is located in the middle of a right side edge of the right panel.

In an embodiment, a first raised reinforcing rib is disposed on an upper surface of the left panel; and a second raised reinforcing rib is disposed on an upper surface of the right panel.

In an embodiment, a left step portion is provided in the middle of the left side surface of the left panel; and a right step portion is provided in the middle of the right side surface of the right panel, and the right step portion is configured to cooperate with the left step portion.

In an embodiment, each back hook of the multiple back hooks defines an opening facing to the right, an opening of the left insertion notch faces upwards, and an opening of the right insertion notch faces downwards.

In an embodiment, multiple fastening holes are disposed at a right edge of a bottom surface of the right bottom plate, and a left edge of the left bottom plate defines multiple back hooks; and each back hook of the multiple back hooks defines an opening facing to the right; an opening of the left insertion notch faces downwards; and an opening of the right insertion notch faces upwards.

The fasteners of the present disclosure at least have the following beneficial technical effects. When the fastener of the present disclosure is used in a bra, a standard bra is obtained, that is, a product which is convenient for right-handed women to use, the left fastening part is connected with the left end of the bra, and the right fastening part is connected with the right fastening part of the bra. When wearing the standard bra, a right-handed user holds the left fastening part with his left hand with the left insertion notch on the left fastening part facing upwards, and the right-handed user holds the right fastening part with her right hand with the right insertion notch on the right fastening part facing downwards. After aligning the right insertion notch with the left insertion notch, the right-handed user uses her right hand and forcibly pushes the right fastening part downward, so that the left fastening part and the right fastening part are embedded together through the right insertion notch and the left insertion notch. As such, the left fastening part and the right fastening part form a whole, the left side surface of the left panel is attached to the right side surface of the right panel, and the joint portion at the attachment position thereof is S-shaped, that is, the wearing of the bra is completed. For the fastener used by a left-handed user, the opening of the left insertion notch on the left fastening part is downward, and the opening of the right insertion notch on the right fastening part is upward. When wearing, the left-handed user grasps the right fastening part with her right hand and the left fastening part with her left hand. After aligning the left insertion notch with the right insertion notch, the left fastening part is forcibly pushed down by the left hand of the left-handed user, and the wearing action is also completed, and the joint portion at the attachment position thereof is 2-shaped. Compared with the existing similar products, when wearing the bra with the fastener of the present disclosure, the user does not need to fasten multiple smaller back buckles and multiple smaller back hooks together, but only needs to fasten the left fastening part and the right fastening part together at one time, so that a wearing action of the bra can be completed, and the bra is convenient to use, especially suitable for women with poor hands or special body shapes, and has a wider application range.

DETAILED DESCRIPTION OF EMBODIMENTS

In order to enable those skilled in the art to better understand the technical solutions of the present disclosure, the present disclosure will be further described in detail below in conjunction with the accompanying drawings and embodiments.

Figure 23:
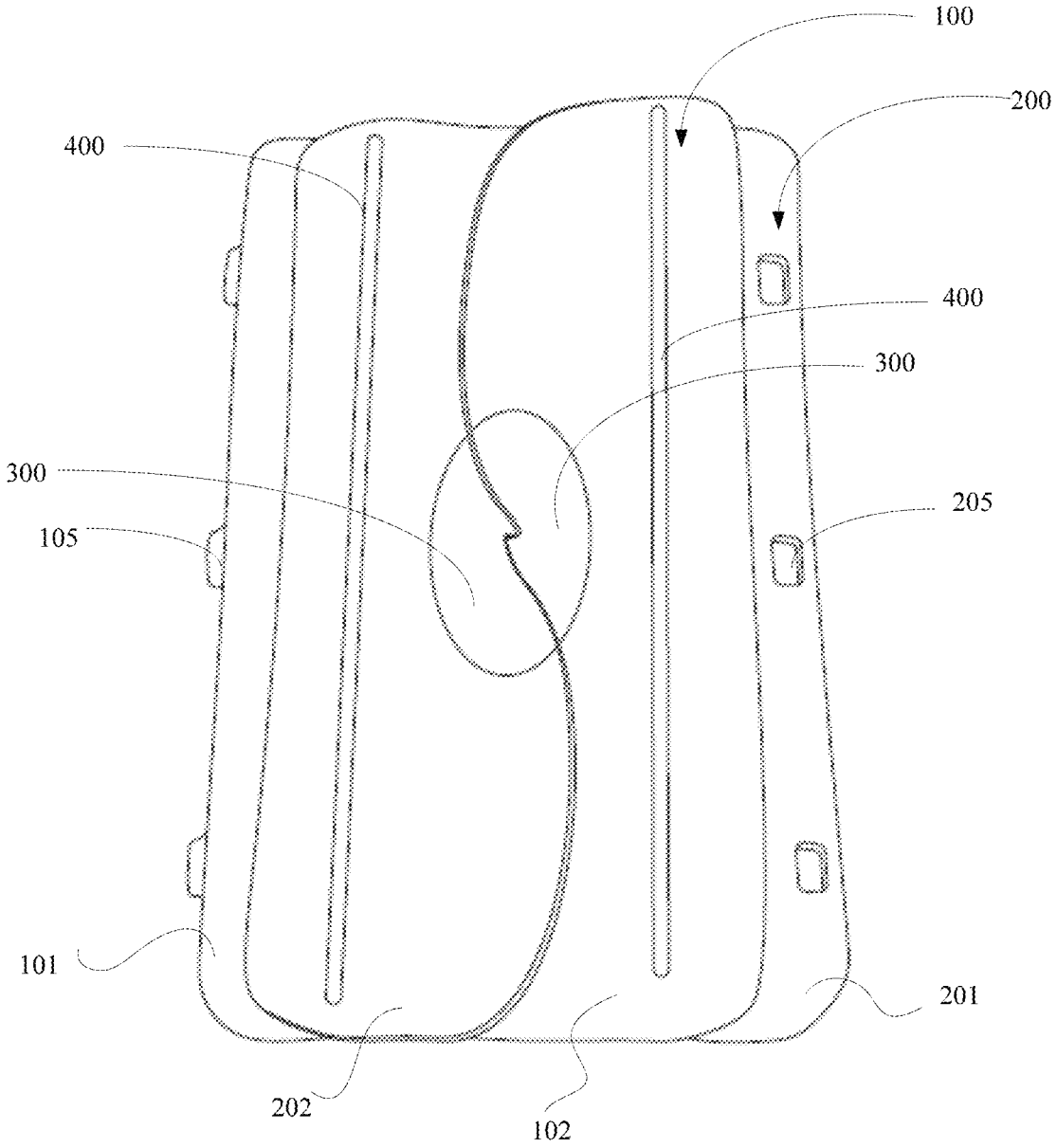
FIG. 23 illustrates a perspective view of the S-shaped fastener in which the left fastener of FIG. 1 and a right fastener of FIG. 4 are connected together.

As illustrated in FIG. 1 through FIG. 6, a first embodiment of the present disclosure provides an S-shaped fastener for the back of a bra. The first embodiment takes a standard fastener as an example to explain the S-shaped fastener for the back of a bra. The bra using the fastener of the first embodiment includes two back sheets respectively disposed at two ends of the bra, with several columns of back buckles disposed on the back sheet (also referred to as left back sheet) at a left side of the bra and a column of fastening hooks on a free end of the back sheet (also referred to as right back sheet) at a right side of the bra. The fastener is an assembly, which includes: a left fastening part 100 for connecting to a left end of the bra, that is, connecting to the left back sheet; and a right fastening part 200 for connecting to a right end of the bra, that is, connecting to the right back piece. Specifically, the left fastening part 100 includes a left bottom plate 101, a left panel 102 overlapped on a surface of the left bottom plate 101, and a left insertion notch 103 defined between the left bottom plate 101 and the left panel 102. The right fastening part 200 includes a right bottom plate 201, a right panel 202 overlapped on a surface of the right bottom plate 201, and a right insertion notch 203 formed between the right bottom plate 201 and right insertion notch 203. When the left fastening part 100 is connected to the right fastening part 200, the left fastening part 100 and the right fastening part 200 are mutually embedded through the left insertion notch 103 and the right insertion notch 203, as shown in FIG. 23.

Figure 3:
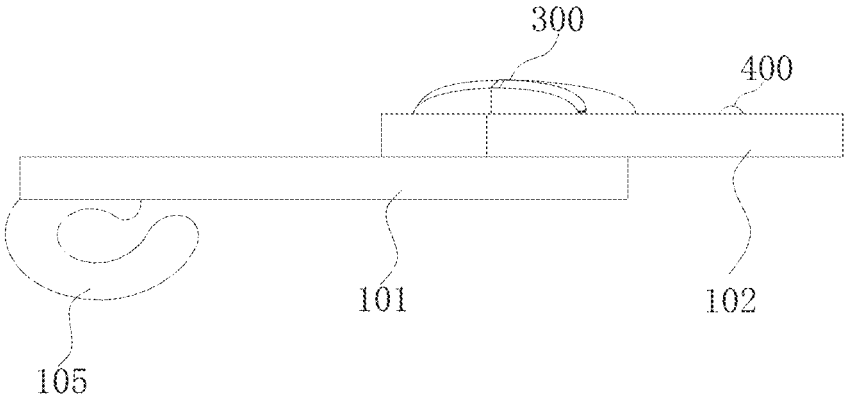
FIG. 3 illustrates a bottom view of the standard left fastening part according to an embodiment of the disclosure.
Figure 6:
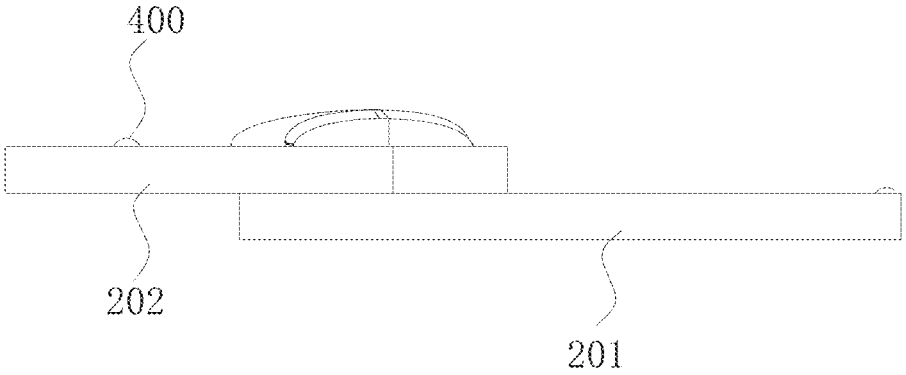
FIG. 6 illustrates a bottom view of the standard right fastening part according to an embodiment of the disclosure.

The so-called overlapping (i.e., overlapped) means that one plate (i.e., the left panel 102 or right panel 202) is disposed on a surface of another plate (i.e., the left bottom plate 101 or the right bottom plate 201), that is, the two plates are located in different planes after being connected, and edges of overlapped sides of the two plates are staggered (that is to say, the left panel 102 is disposed on an upper surface of the left bottom plate 101, and the right panel 202 is disposed on an upper surface of the right bottom plate 201), as shown in FIG. 3 and FIG. 6 for details.

In an embodiment, the left bottom plate 101 and the left panel 102, the right bottom plate 201 and the right panel 202 are all made of flat plates, and an orthographic projection of the left fastening part 100 is square, and an irregular gap in a corresponding orthographic projection figure represents the left insertion notch 103. Similarly, an orthographic projection of the right fastening part 200 is square, and an irregular gap in a corresponding orthographic projection pattern represents the right insertion notch 203.

The left fastening part 100 and the right fastening part 200 are connected by an inserting manner through the left insertion notch 103 and the right insertion notch 203, and a shape of the left insertion notch 103 is consistent with a shape of the right insertion notch 203.

Figure 1:
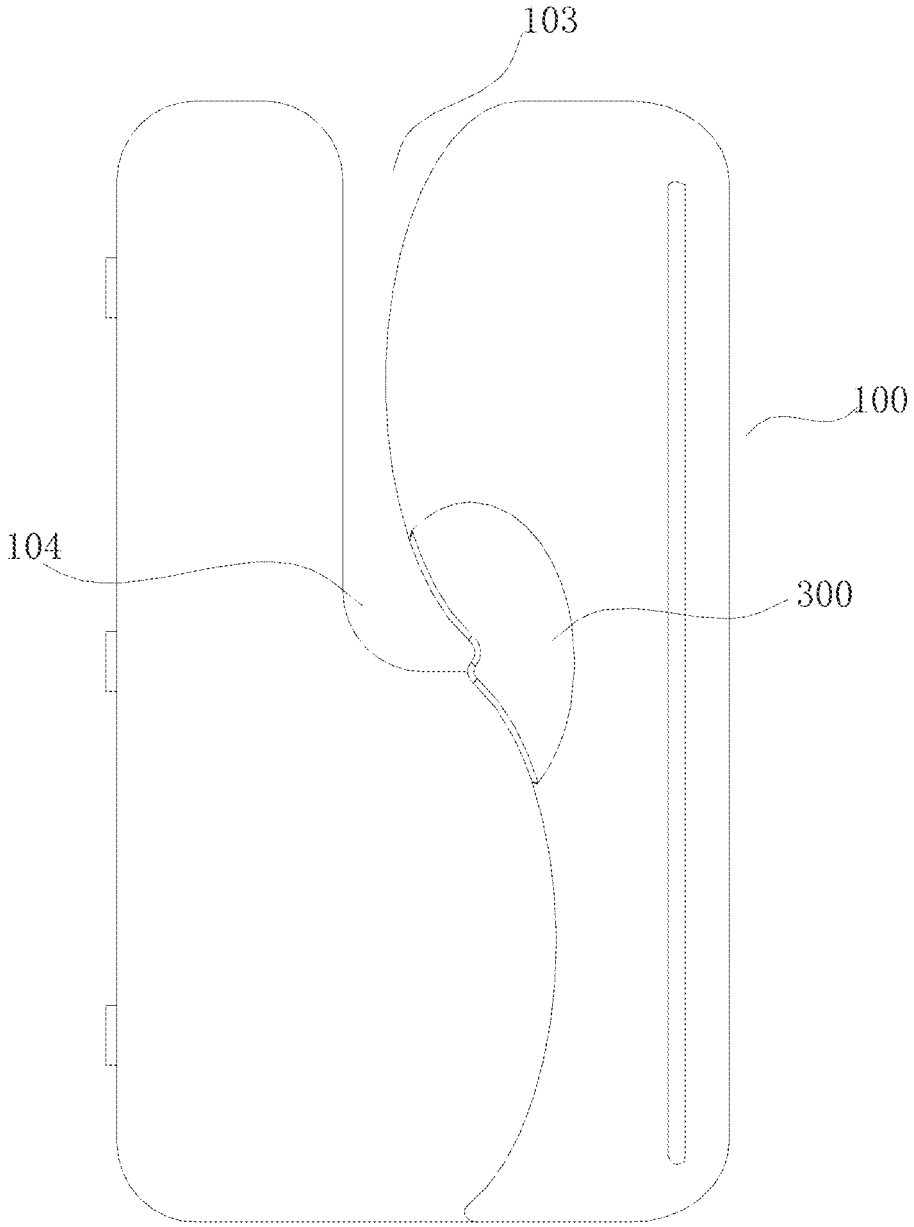
FIG. 1 illustrates a front view of a standard left fastening part according to an embodiment of the present disclosure.
Figure 2:
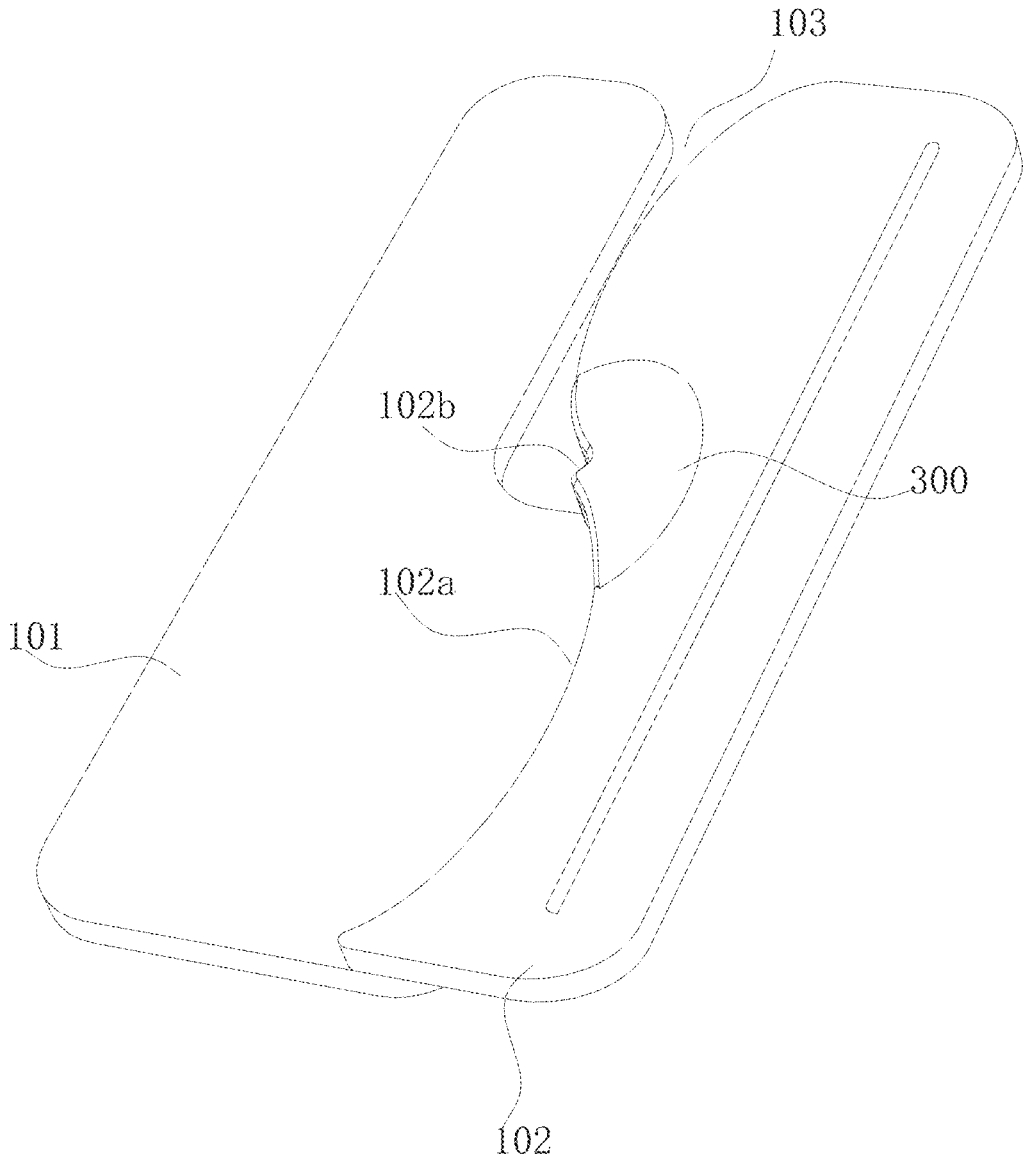
FIG. 2 illustrates a perspective view of the standard left fastening part according to an embodiment of the disclosure.
Figure 4:
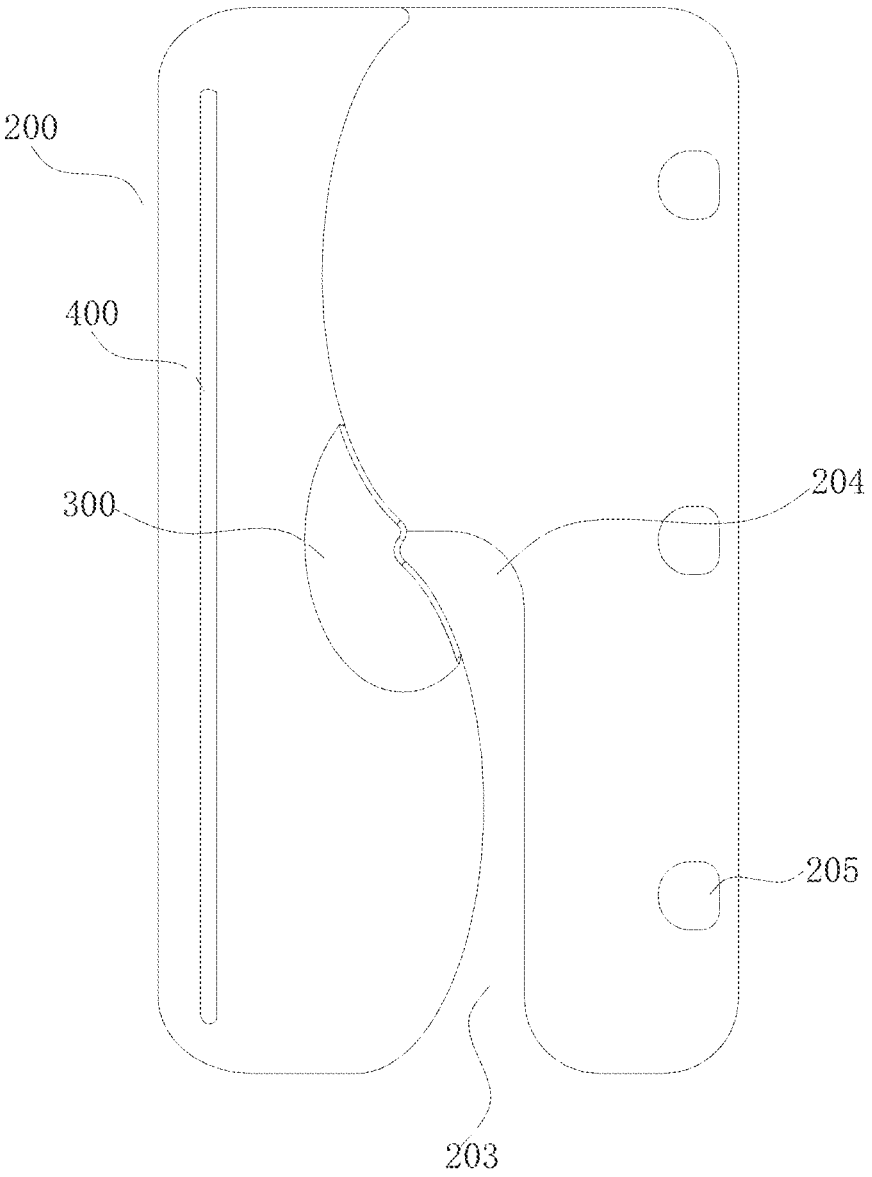
FIG. 4 illustrates a front view of a standard right fastening part according to an embodiment of the disclosure.
Figure 5:
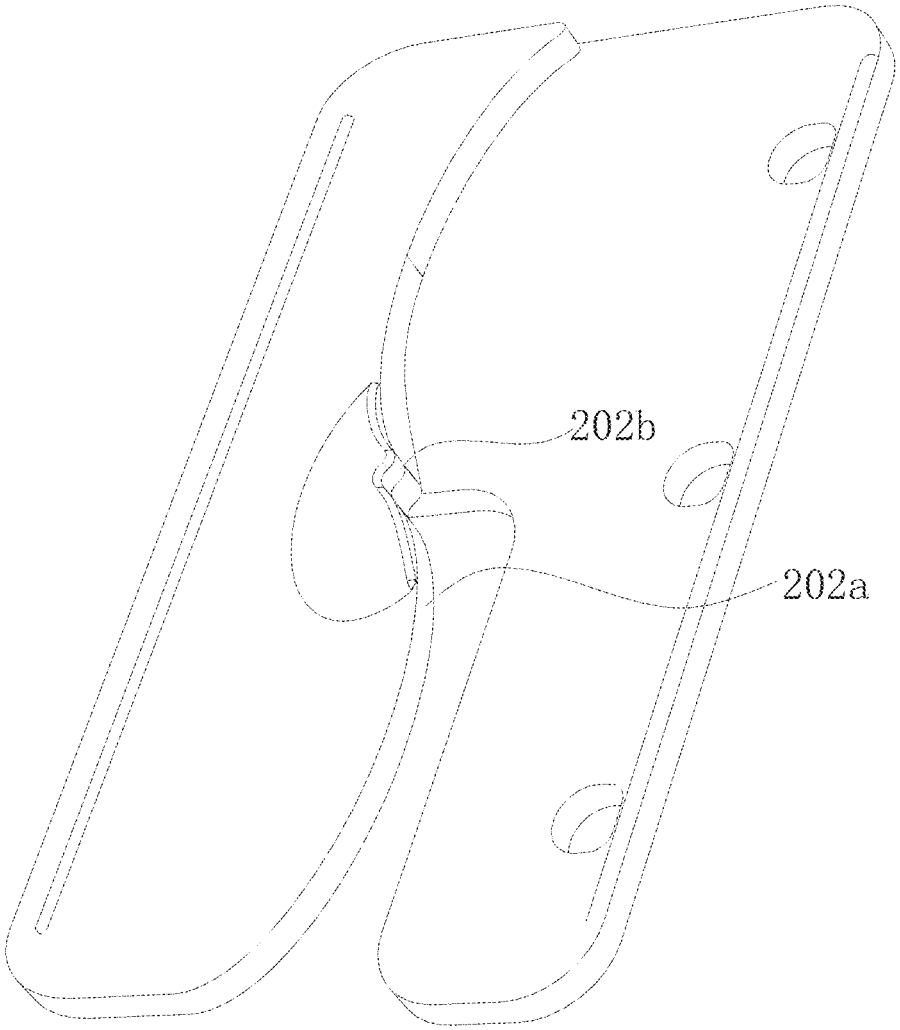
FIG. 5 illustrates a perspective view of the standard right fastening part according to an embodiment of the disclosure.

Specifically, as illustrated in FIGS. 1-2, the left bottom plate 101 defines an L-shaped upper notch 104, a left side surface 102*a* of the left panel 102 is S-shaped, and the left insertion notch 103 is a gap between an upper part of the left side surface 102*a* and a vertical surface of the L-shaped upper notch 104. Corresponding to the shape of the left fastening part 100, as illustrated in FIGS. 4-5, the right bottom plate 201 defines an L-shaped lower notch 204, a right side surface 202*a* of the right panel 202 is S-shaped, and the right insertion notch 203 is a gap between a lower part of the right side surface 202*a* and a vertical surface of the L-shaped lower notch 204.

Because the left bottom plate 101 is overlapped with the left panel 102, and the right bottom plate 201 is overlapped with the right panel 202, when the left fastening part 100 and the right fastening part 200 are connected, the left side surface 102*a* of the left panel 102 and the right side surface 202*a* of the right panel 202 are attached to each other, and after the left side surface 102*a* and the right side surface 202*a* are attached to each other, a joint portion between the left side surface 102*a* and the right side surface 202*a* is S-shaped. Specifically, the left side surface 102*a* is S-shaped as a whole, and the right side surface 202*a* is also S-shaped as a whole, and shapes of the left side surface 102*a* and the right side surface 202*a* are the same.

As illustrated in FIG. 3, in an embodiment, in order to fix the fastener of the present disclosure on the bra, multiple back hooks 105 (for clarity, only one hook is illustrated in FIG. 3) are disposed at a left edge of a bottom surface of the left bottom plate 101, and the multiple back hooks 105 are arranged in a column for connecting with one column of back buckles on the left back piece. The number of the multiple back hooks 105 is not particularly limited, because the multiple back hooks 105 are connected with the one column of back buckles on the left back piece, so the number of the multiple back hooks 105 is the same as the number of the one column of back buckles on the left back piece. According to a general structure, each column of back buckles on the bra includes two or more single back buckles, and thus, the column of back hooks 105 includes two or more single back hooks. As illustrated in FIG. 5, a right edge of the right bottom plate 201 defines multiple fastening holes 205. Similarly, the multiple fastening holes 205 are arranged in a column, and the right bottom plate 201 is connected with the column of back hooks located at the free end of the right back piece through the multiple fastening holes 205. As the column of back hooks on the bra usually includes two or more single back hooks, and thus, the column of fastening holes 205 includes two or more single fastening holes. For example, for the fastener of the first embodiment of the present disclosure, three single back hooks 105 and three single fastening holes 205 are provided.

As illustrated in FIGS. 1-6, in the first embodiment, each back hook 105 defines an opening facing to the right (that is to say, facing towards a right edge of the bottom surface of the left bottom plate 101); an opening of the left insertion notch 103 faces upwards; and an opening of the right insertion notch 203 faces downwards. By adopting this structure, most people can use the fastener, that is, right-handed users can use the bra with the fastener.

After the left fastening part 100 is combined with the right fastening part 200, a middle part of each of combined portions (i.e., contact portions) of the left fastening part 100 and the right fastening part 200 bears the greatest stress. Therefore, an arc convex plate 300 is disposed on a surface of the left panel 102, and an edge of the arc convex plate 300 is located in the middle of a left side edge of the left panel 102; and an arc convex plate 300 is disposed on a surface of the right panel 202, and an edge of the arc convex plate 300 is located in the middle of a right side edge of the right panel 202. In an embodiment, the arc-shaped convex plate 300 on the left panel 102 is integrally formed with the left panel 102 (i.e., the arc-shaped convex plates 300 on the left panel 102 and the left panel 102 are integrated into a single-piece structure), the arc-shaped convex plates 300 on the right panel 202 is integrally formed with the right panel 202 (i.e., the arc-shaped convex plates 300 on the right panel 202 and the right panel 202 are integrated into a single-piece structure); an edge shape (i.e., a shape of an edge proximate to the left side edge of the left panel 102) of the arc-shaped convex plate 300 on the left panel 102 is consistent with the left side edge of the left panel 102; an edge shape (i.e., a shape of an edge proximate to right side edge of the right panel 202) of the arc-shaped convex plate 300 on the right panel 202 is consistent with the right side edge of the right panel 202. The arc-shaped convex plates 300 are used to reinforce the positions where the left panel 102 and the right panel 202 are most stressed, so as to prevent the positions from being damaged when the left panel 102 and the right panel 202 are used for a long time, thereby shortening the service life of the whole fastener.

In an embodiment, in order to strengthen the left panel 102 and the right panel 202, a raised reinforcing rib 400 is arranged on each of upper surfaces of the left panel 102 and the right panel 202, and the corresponding reinforcing rib 400 is disposed along a longitudinal direction of each of the left panel 102 and the right panel 202.

As illustrated in FIG. 2 and FIG. 4, in order to realize the close fastening between the left panel 102 and the right panel 202, a left step portion 102*b* is provided in the middle of the left side surface 102*a* of the left panel 102; and a right step portion 202*b* is provided in the middle of the right side surface 202*a* of the right panel 202, and the right step portion 202*b* is configured to combine with the left step portion 102*b*.

Figure 7:
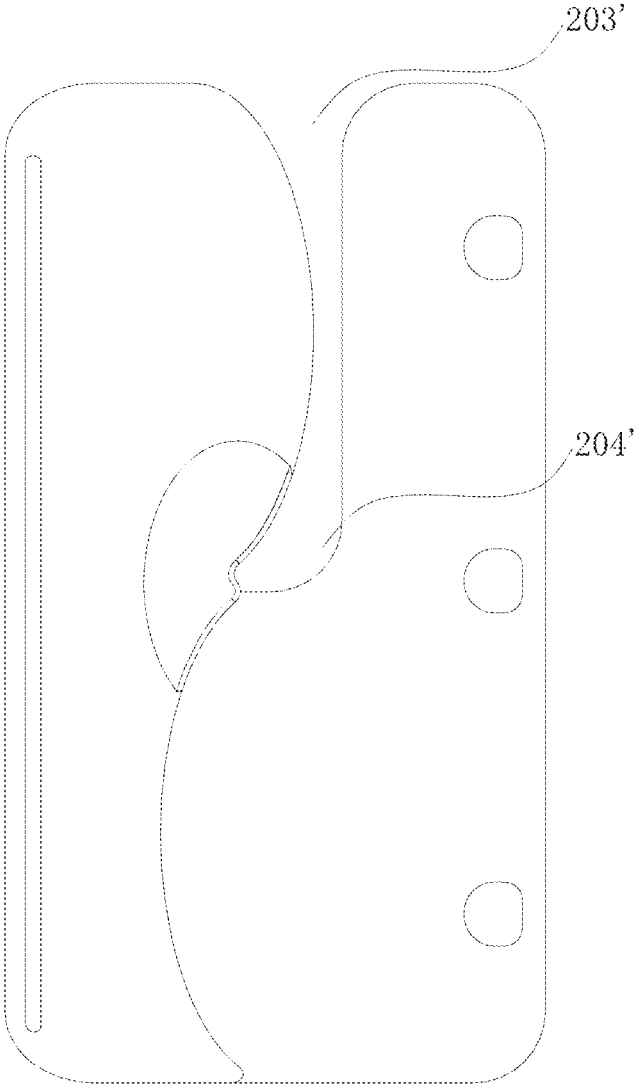
FIG. 7 illustrates a front view of a left-handed right fastening part according to an embodiment of the disclosure.
Figure 8:
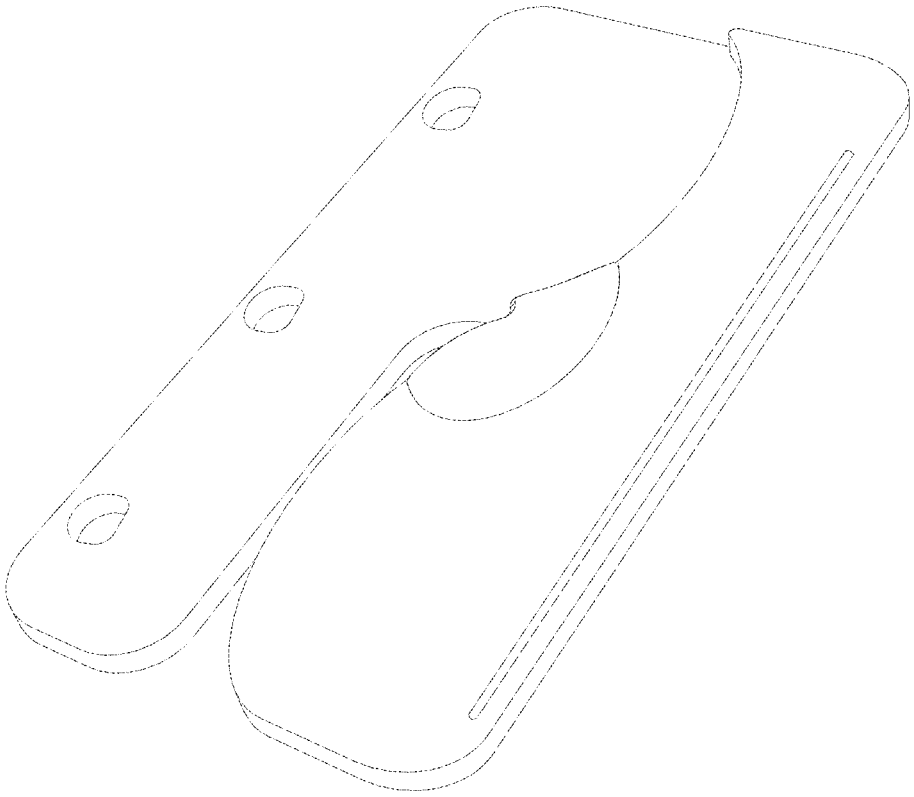
FIG. 8 illustrates a perspective view of the left-handed right fastening part according to an embodiment of the disclosure.
Figure 9:
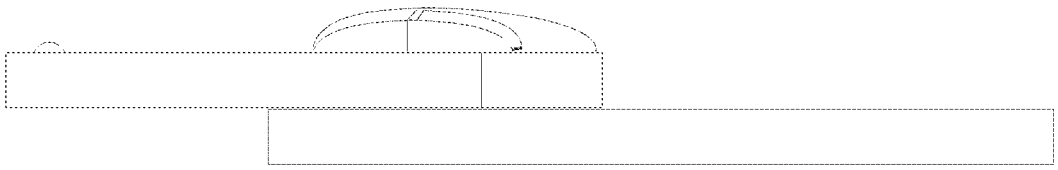
FIG. 9 illustrates a bottom view of the left-handed right fastening part according to an embodiment of the disclosure.
Figure 10:
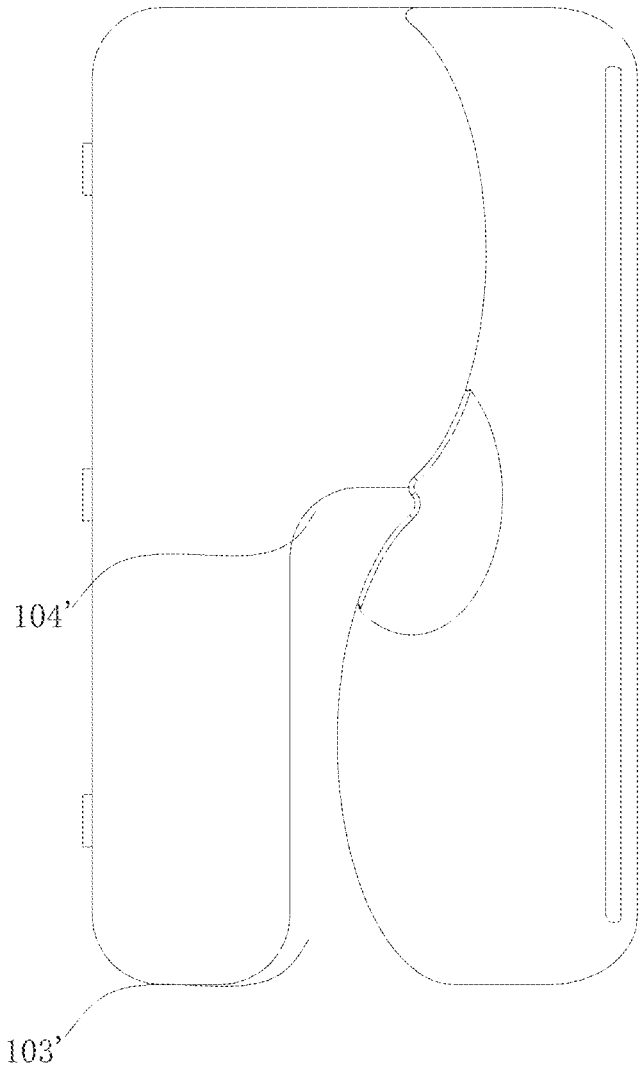
FIG. 10 illustrates a front view of a left-handed left fastening part according to an embodiment of the disclosure.
Figure 11:
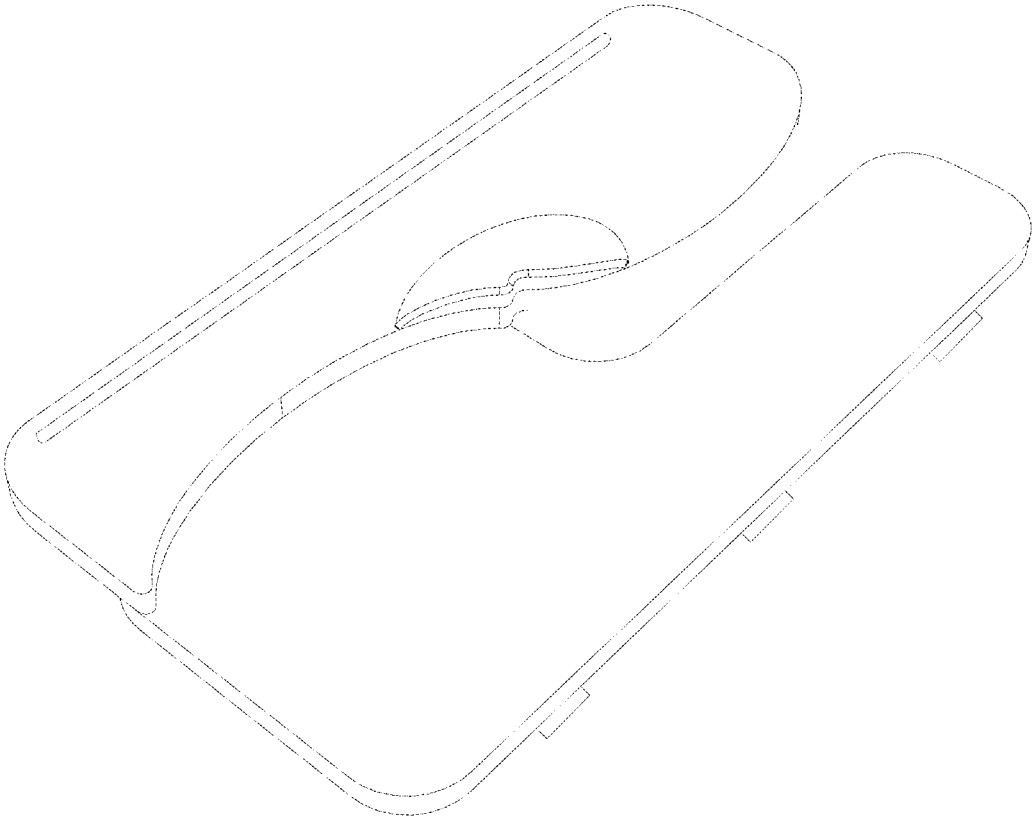
FIG. 11 illustrates a perspective view of the left-handed left fastening part according to an embodiment of the disclosure.
Figure 12:
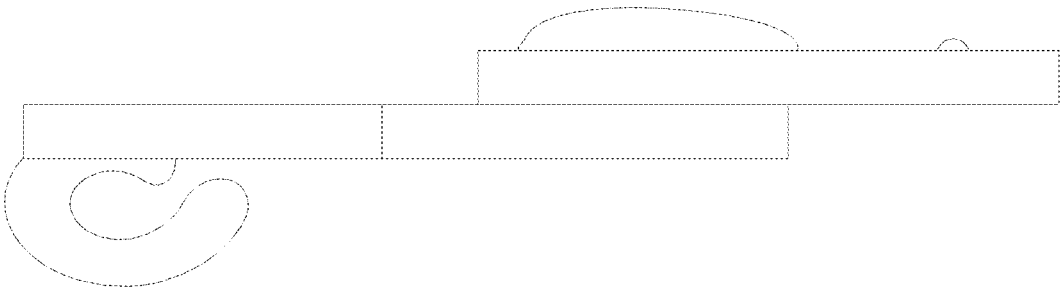
FIG. 12 illustrates a bottom view of the left-handed left fastening part according to an embodiment of the disclosure.
Figure 13:
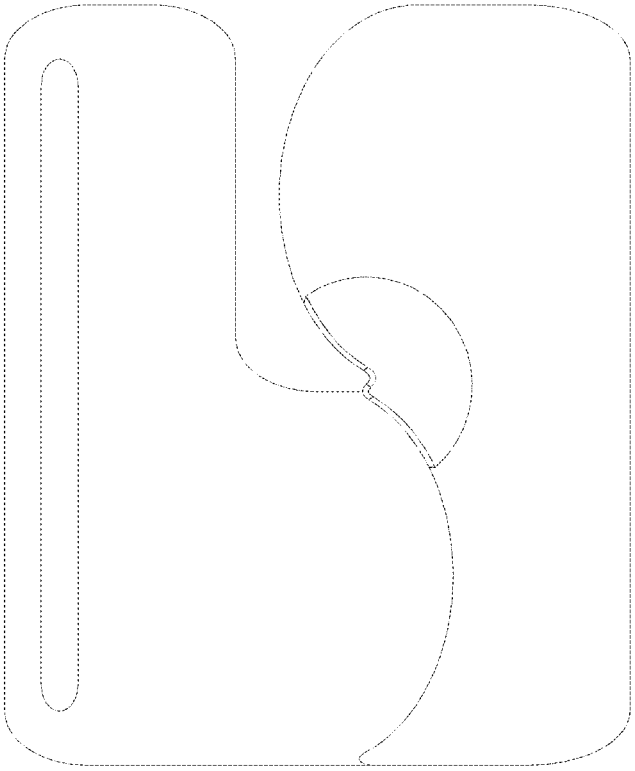
FIG. 13 illustrates a front view of a left fastening part used on a sports bra according to an embodiment of the disclosure.
Figure 14:
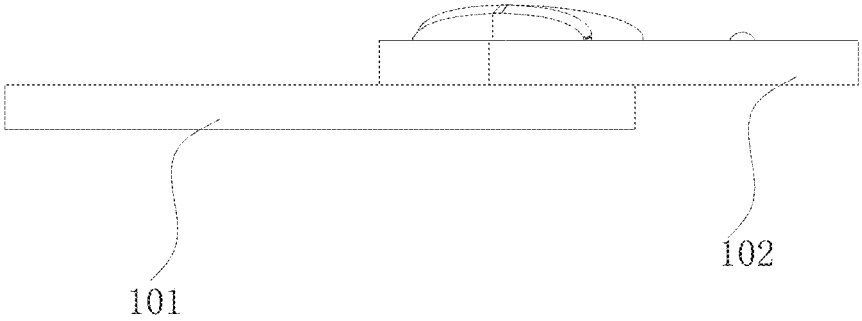
FIG. 14 illustrates a bottom view of the left fastening part used on the sports bra according to an embodiment of the disclosure.
Figure 15:
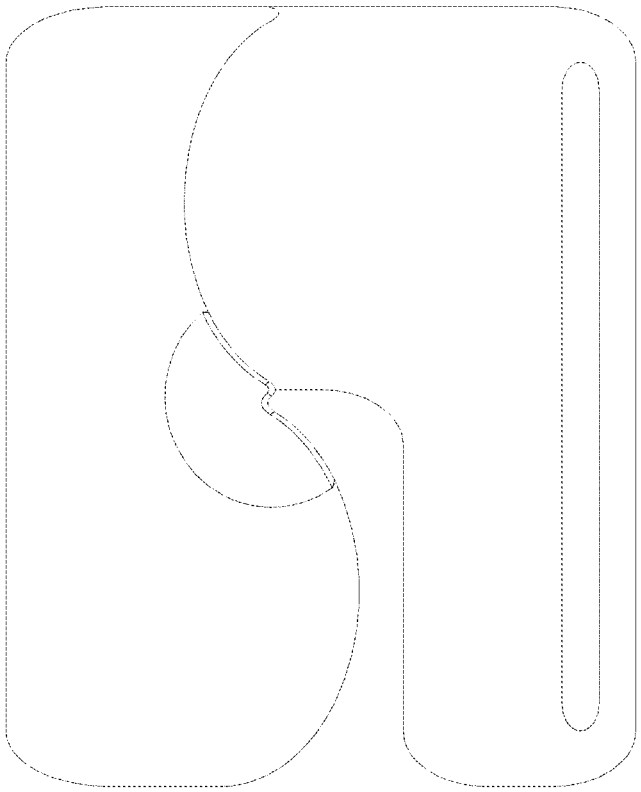
FIG. 15 illustrates a front view of a right fastening part used on a sports bra according to an embodiment of the disclosure.
Figure 16:
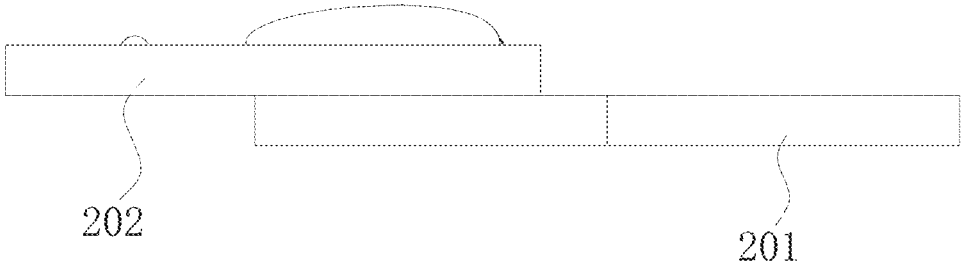
FIG. 16 illustrates a bottom view of the right fastening part used on the sports bra according to an embodiment of the disclosure.
Figure 17:
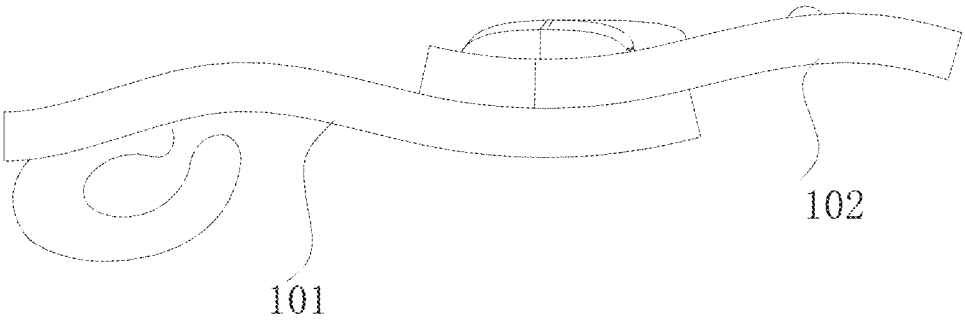
FIG. 17 illustrates a bottom view of a standard left fastening part made of a wavy (corrugated) plate according to an embodiment of the disclosure.
Figure 18:
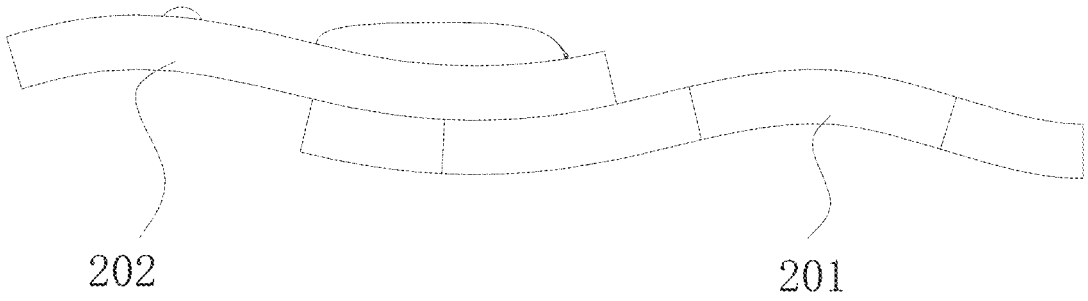
FIG. 18 illustrates a bottom view of a standard right fastening part made of a wavy (corrugated) plate according to an embodiment of the disclosure.
Figure 19:
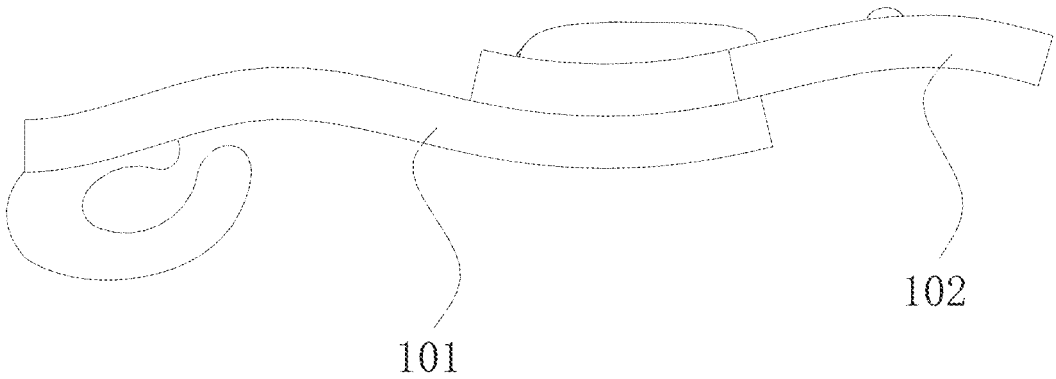
FIG. 19 illustrates a bottom view of a left-handed left fastening part made of a wavy (corrugated) plate according to an embodiment of the disclosure.
Figure 20:
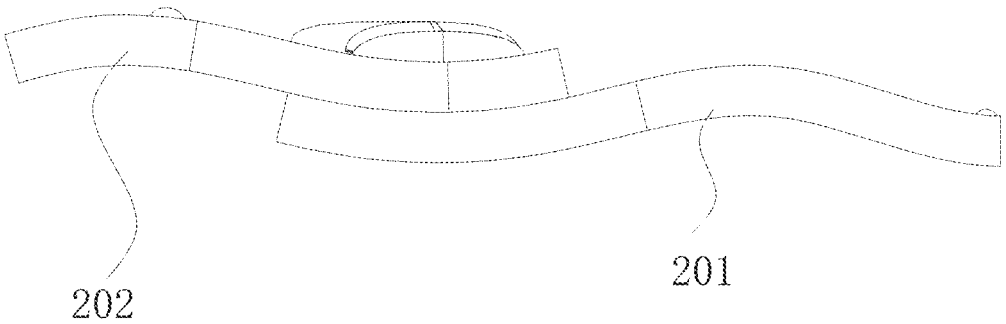
FIG. 20 illustrates a bottom view of a left-handed right fastening part made of a wavy (corrugated) plate according to an embodiment of the disclosure.
Figure 21:
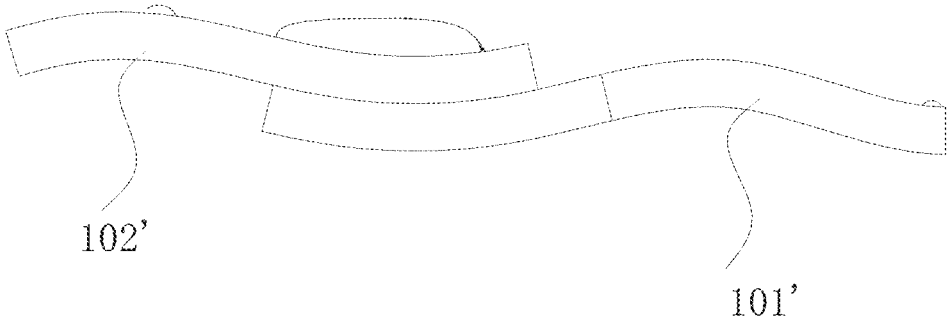
FIG. 21 illustrates a bottom view of a sports bra right fastening part made of a wavy (corrugated) plate according to an embodiment of the disclosure.
Figure 22:
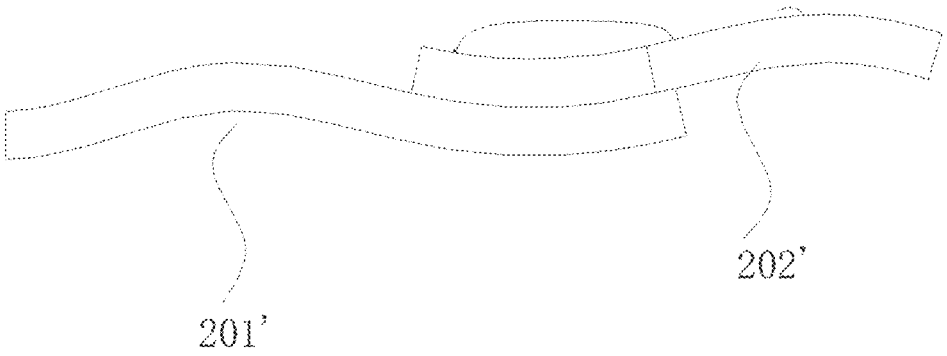
FIG. 22 illustrates a bottom view of a sports bra left fastening part made of a wavy (corrugated) plate according to an embodiment of the disclosure.

As illustrated in FIGS. 7-12, a second embodiment of the present disclosure provides a fastener, which is specially designed for left-handed women who are used to using their left hands. The difference from the fasteners in the first embodiment is that: as illustrated in FIG. 7, a right bottom plate of the second embodiment defines an L-shaped upper notch 204', a right side surface of a right panel of the second embodiment has a "Ƨ" shape, that is, the right side surface of the right panel is inverted S-shaped, and a right insertion notch 203' is a gap between an upper part of the right side surface and a vertical surface of the L-shaped upper notch 204'; and as illustrated in FIG. 10, a left bottom plate of the second embodiment defines an L-shaped lower notch 104', and a left side surface of the left panel of the second embodiment has a "Ƨ" shape, and a left insertion notch 103' is a gap between a lower part of a right side surface and a vertical surface of the L-shaped lower notch 104'.

Besides the above, the structures of the left fastening part and the right fastening part are the same as those of the previous embodiments, and will not be described in detail herein.

As illustrated in FIGS. 13-16, a third embodiment of the present disclosure provides a fastener, which is used on a sports bra. The difference of the fastener of the third embodiment from the fastener of the first embodiment is that: in the third embodiment, a left bottom plate 101 of a left fastening part 100 of the fastener is no longer provided with a column of back hooks 105, while a corresponding right bottom plate 201 is no longer provided with a column of fastening holes 205, that is, the left bottom plate 101 and the right bottom plate 201 of the third embodiment are fixed on the bra by a manner such as sewing. Other structures of the fastener in the third embodiment are consistent with those in the first embodiment and will not be described in detail herein.

In the above embodiments, the left bottom plate 101, the right bottom plate 201, the left panel 102 and the right panel 202, as well as the left bottom plate 101', the right bottom plate 201', the left panel 102' and the right panel 202' which are beneficial to the left hand, are all made of flat plates, but they can also be made of arc panels with wavy cross sections, as illustrated in FIGS. 17-22, beside this, other structures are the same as those of the previous three embodiments.

In summary, compared with the existing similar products, when wearing the bras with the fasteners of the present disclosure, the users does not need to fasten multiple smaller back buckles and multiple smaller back hooks together, but only needs to fasten the left fastening part 100 and the right fastening part 200 together at one time to complete the wearing action. The fasteners in the present disclosure are convenient to use, especially suitable for women with poor hands and special body shapes, and have a wider application range.

In the above description, it should be noted that the terms "installation", "connecting" and "connection" should be understood broadly, for example, they may be fixed connection, detachable connection or integrated connection; may be directly connected, may also be indirectly connected through an intermediate medium, and may be the internal communication of two components; the term "disposed" should be understood as "installed in" or "arranged in", including fixed installation, movable installation and other installation methods.

Apparently, the embodiments described above are only parts of the embodiments of the present disclosure, not all the embodiments. The exemplary embodiments of the present disclosure are shown in the attached drawings, but they are not intended to limit the scope of protection of the present disclosure. The present disclosure can be realized in many different forms. Further, these embodiments are provided to merely make the understanding of the disclosure of the present disclosure more thorough and comprehensive. Any equivalent structure made by using the description and attached drawings of the present disclosure, which is directly or indirectly used in other related technical fields, is equally within the scope of protection of the present disclosure.

What is claimed is:

1. An S-shaped fastener for the back of a bra, and the S-shaped fastener comprising: a left fastening part for connecting to a left end of the bra, and a right fastening part for connecting to a right end of the bra;

wherein the left fastening part comprises: a left bottom plate, a left panel overlapped on a surface of the left bottom plate, and a left insertion notch defined between the left bottom plate and the left panel;

wherein the right fastening part comprises: a right bottom plate, a right panel overlapped on a surface of the right bottom plate, and a right insertion notch defined between the right bottom plate and the right panel;

wherein when the left fastening part is connected to the right fastening part, the left fastening part and the right fastening part are mutually embedded through the left insertion notch and the right insertion notch;

wherein the left bottom plate defines an L-shaped upper notch, a left side surface of the left panel is S-shaped, and the left insertion notch is a gap between an upper part of the left side surface and a vertical surface of the L-shaped upper notch;

wherein the right bottom plate defines an L-shaped lower notch, a right side surface of the right panel is S-shaped, and the right insertion notch is a gap between a lower part of the right side surface and a vertical surface of the L-shaped lower notch;

wherein a plurality of back hooks are disposed at a left edge of a bottom surface of the left bottom plate, and a right edge of the right bottom plate defines a plurality of fastening holes;

wherein the plurality of back hooks are arranged in a column, and the number of the plurality of back hooks is at least two; and wherein the plurality of fastening holes are arranged in a column, and the number of the plurality of fastening holes is at least two.

2. The S-shaped fastener for the back of the bra as claimed in claim 1, wherein when the left fastening part and the right fastening part are connected, the left side surface of the left panel and the right side surface of the right panel are attached to each other; and after the left side surface and the right side surface are attached to each other, a joint portion between the left side surface and the right side surface is S-shaped.

3. The S-shaped fastener for the back of the bra as claimed in claim 1, wherein a first arc convex plate is disposed on a surface of the left panel, and an edge of the first arc convex plate is located in the middle of a left side edge of the left panel; and wherein a second arc convex plate is disposed on a surface of the right panel, and an edge of the second arc convex plate is located in the middle of a right side edge of the right panel.

4. The S-shaped fastener for the back of the bra as claimed in claim 1, wherein a first raised reinforcing rib is disposed on an upper surface of the left panel; and wherein a second raised reinforcing rib is disposed on an upper surface of the right panel.

5. The S-shaped fastener for the back of the bra as claimed in claim 1, wherein a left step portion is provided in the middle of the left side surface of the left panel; and a right step portion is provided in the middle of the right side surface of the right panel, and the right step portion is configured to cooperate with the left step portion.

6. The S-shaped fastener for the back of the bra as claimed in claim 1, wherein each back hook of the plurality of back hooks defines an opening facing to the right; an opening of the left insertion notch faces upwards; and an opening of the right insertion notch faces downwards.

7. A fastener for a bra, and the fastener comprising: a first fastening part for connecting to a first end of the bra and a second fastening part for connecting to a second end opposite to the first end of the bra;

wherein the first fastening part comprises: a first bottom plate and a first panel partially disposed on a surface of the first bottom plate, and a first insertion notch is defined between the first bottom plate and the first panel;

wherein the second fastening part comprises: a second bottom plate and a second panel partially disposed on a surface of the second bottom plate, and a second insertion notch is defined between the second bottom plate and the second panel;

wherein when the first fastening part is connected to the second fastening part, the first fastening part and the second fastening part are mutually embedded through the first insertion notch and the second insertion notch;

wherein the first bottom plate defines an L-shaped lower notch, a side surface facing towards the first insertion notch of the first panel is inverted S-shaped, and the first insertion notch is a gap between an upper part of the side surface of the first panel and a vertical surface of the L-shaped lower notch;

wherein the second bottom plate defines an L-shaped upper notch, a side surface facing towards the second insertion notch of the second panel is inverted S-shaped, and the second insertion notch is a gap between an upper part of the side surface of the second panel and a vertical surface of the L-shaped upper notch;

wherein at least one back hook is disposed at an edge facing away from the first panel of a bottom surface of the first bottom plate, and an edge facing away from the second panel of the second bottom plate defines at least one fastening hole; and wherein each back hook of at least one back hook defines an opening facing to the right, an opening of the first insertion notch faces downwards, and an opening of the second insertion notch faces upwards.

8. The fastener for the bra as claimed in claim 7, when the first fastening part and the second fastening part are connected to insert with each other, the side surface of the first panel and the side surface of the second panel are attached to each other, and a connection portion between the side surface of the first panel and the side surface of the second panel is inverted S-shaped.

9. The fastener for the bra as claimed in claim 7, wherein a first arc convex plate is disposed in the middle of an upper surface of the first panel, and a side edge of the first arc convex plate is aligned with a side edge facing towards the first insertion notch of the first panel; and wherein a second arc convex plate is disposed in the middle of an upper surface of the second panel, and a side edge of the second arc convex plate is aligned with a side edge facing towards the second insertion notch of the second panel.

10. The fastener for the bra as claimed in claim 7, wherein a first raised reinforcing rib is disposed on an upper surface of the first panel and extends in a direction along which the first insertion notch extends; and wherein a second raised reinforcing rib is disposed on an upper surface of the second panel and extends in a direction along which the second insertion notch extends.

11. The fastener for the bra as claimed in claim 7, wherein the first bottom plate, the first panel, the second bottom plate, and the second panel are all flat plates; or the first bottom plate, the first panel, the second bottom plate, and the second panel are all arc panels with wavy cross sections.

12. The fastener for the bra as claimed in claim 7, wherein a shape of the first insertion notch is the same as a shape of the second insertion notch.

13. An S-shaped fastener for the back of a bra, and the S-shaped fastener comprising: a left fastening part for connecting to a left end of the bra, and a right fastening part for connecting to a right end of the bra;

wherein the left fastening part comprises: a left bottom plate, a left panel overlapped on a surface of the left bottom plate, and a left insertion notch defined between the left bottom plate and the left panel;

wherein the right fastening part comprises: a right bottom plate, a right panel overlapped on a surface of the right bottom plate, and a right insertion notch defined between the right bottom plate and the right panel;

wherein when the left fastening part is connected to the right fastening part, the left fastening part and the right fastening part are mutually embedded through the left insertion notch and the right insertion notch;

wherein the left bottom plate defines an L-shaped upper notch, a left side surface of the left panel is S-shaped, and the left insertion notch is a gap between an upper part of the left side surface and a vertical surface of the L-shaped upper notch;

wherein the right bottom plate defines an L-shaped lower notch, a right side surface of the right panel is S-shaped, and the right insertion notch is a gap between a lower part of the right side surface and a vertical surface of the L-shaped lower notch;

wherein a first arc convex plate is disposed on a surface of the left panel, and an edge of the first arc convex plate is located in the middle of a left side edge of the left panel; and a second arc convex plate is disposed on a surface of the right panel, and an edge of the second arc convex plate is located in the middle of a right side edge of the right panel;

wherein a first raised reinforcing rib is disposed on an upper surface of the left panel; and a second raised reinforcing rib is disposed on an upper surface of the right panel.

* * * * *